US008978633B2

(12) United States Patent
Hedeen, Jr.

(10) Patent No.: US 8,978,633 B2
(45) Date of Patent: Mar. 17, 2015

(54) TOY PROJECTILE LAUNCHING APPARATUS

(75) Inventor: Clemens V. Hedeen, Jr., Sturgeon Bay, WI (US)

(73) Assignee: Hedeen International, LLC, Sturgeon Bay, WI (US)

( * ) Notice: Subject to any disclaimer, the term of this patent is extended or adjusted under 35 U.S.C. 154(b) by 683 days.

(21) Appl. No.: 12/976,387

(22) Filed: Dec. 22, 2010

(65) Prior Publication Data

US 2011/0151741 A1 Jun. 23, 2011

Related U.S. Application Data

(60) Provisional application No. 61/289,748, filed on Dec. 23, 2009.

(51) Int. Cl.
*F41B 7/00* (2006.01)
*A63H 27/00* (2006.01)

(52) U.S. Cl.
CPC ..... *A63H 27/00* (2013.01)
USPC ..... 124/16

(58) Field of Classification Search
USPC ..... 124/16, 44
See application file for complete search history.

(56) References Cited

U.S. PATENT DOCUMENTS

| | | | | |
|---|---|---|---|---|
| 849,166 | A | 4/1907 | Smith et al. | |
| 3,717,136 | A | 2/1973 | Gay et al. | |
| 4,248,202 | A | 2/1981 | Jaworski et al. | |
| 4,372,281 | A | 2/1983 | Fiorani | |
| 5,050,575 | A | 9/1991 | Killion | |
| 5,996,564 | A * | 12/1999 | Kotowski | 124/6 |
| 6,733,356 | B2 | 5/2004 | Lee | |

* cited by examiner

*Primary Examiner* — Melba Bumgarner
*Assistant Examiner* — Amir Klayman
(74) *Attorney, Agent, or Firm* — Gifford, Krass, Sprinkle, Anderson & Citkowski, P.C.; Mark D. Schneider

(57) ABSTRACT

An apparatus may include a projectile and a housing or launcher. The projectile may include wing portion, with the wing portion having an end, a leading edge and a trailing edge. The housing may include a grip, a trigger, and a projectile support platform. The projectile support platform may have a projectile launch key dimensioned to removably receive the end of the wing of the projectile and engage the trailing edge of the wing. The projectile launch key may also be being mechanically connected to the trigger and operate to rotate upon retraction of the trigger and thereby launch the projectile.

17 Claims, 7 Drawing Sheets

FIG. 8
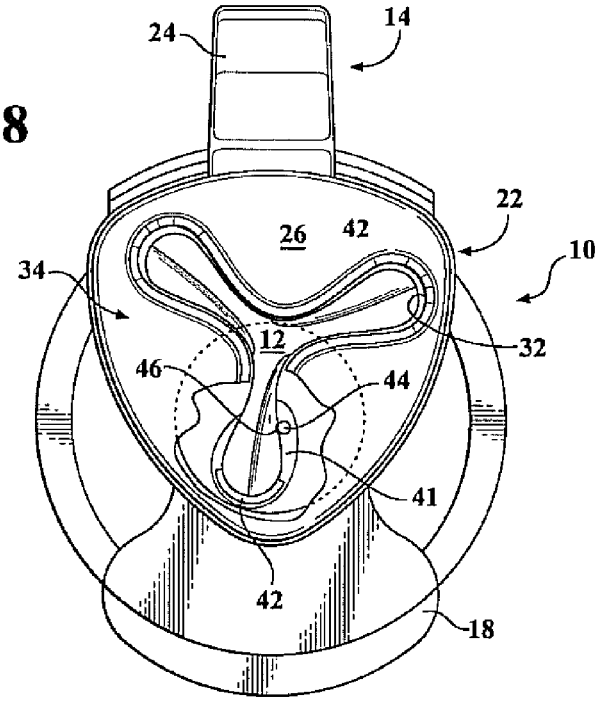
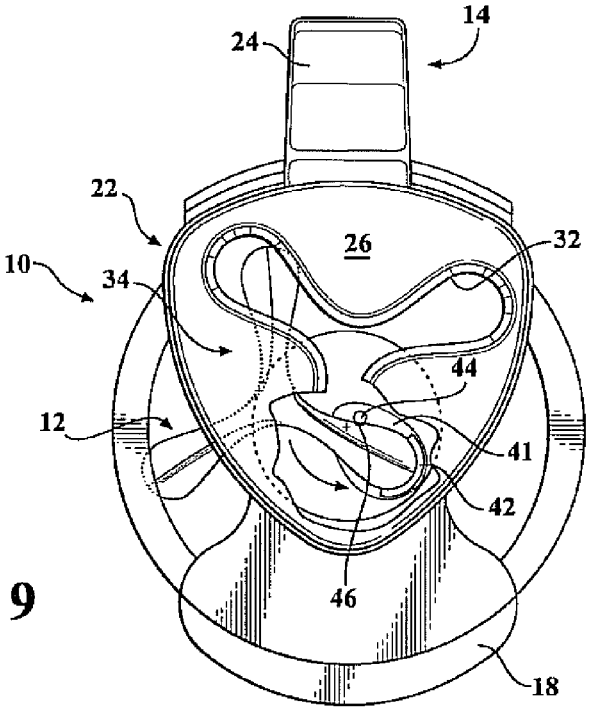
FIG. 9

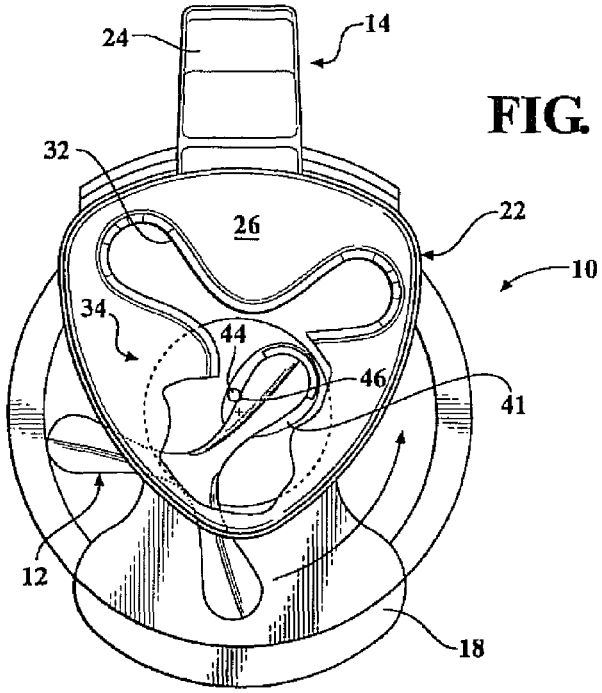
FIG. 10
FIG. 11
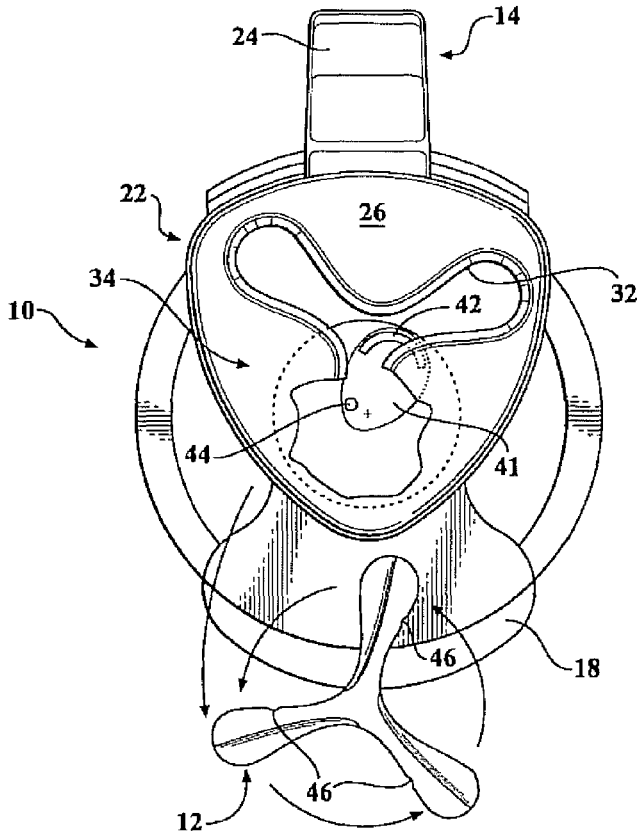

TOY PROJECTILE LAUNCHING APPARATUS

CROSS REFERENCE TO RELATED APPLICATION

This application claims priority of U.S. Provisional Patent Application Ser. No. 61/289,748 filed Dec. 23, 2009, the disclosure of which is incorporated herein by reference in its entirety.

FIELD OF THE INVENTION

An apparatus is disclosed for launching a toy projectile(s). The apparatus may be configured to store one or more returnable projectiles, and may function to impart a spin in the projectiles during launch so that the projectile may be induced to travel away from and then back towards the launch point.

REFERENCE TO RELATED ART

The boomerang is an ancient weapon of war and hunting that may be best known for its ability to change direction in flight and return to the thrower. Over time, this direction changing feature of the boomerang has aided its evolution from use as a weapon into a children's plaything.

Boomerangs are produced in a variety of shapes and sizes. One traditional form of boomerang is essentially a rotating wing shaped from a single flat curved blade. Other boomerang designs include the "fast catch" variety, which usually have three or more symmetrical wings (in the platform view), and "long distance" boomerangs, which are shaped similar to a question mark.

Boomerang throwing techniques can differ from person to person, and depending on the desired result. However, known prior art boomerangs are all thrown by hand. According, it would be advantageous to have an apparatus that may store and successively launch multiple boomerangs or similar projectiles.

SUMMARY OF THE INVENTION

A toy apparatus may include a projectile and a housing or launcher. The projectile may include one or more wing or blade portions that each may have end, a leading edge and a trailing edge. The housing or launcher of the apparatus may include a grip, a trigger, and a projectile support platform. A projectile launch key may be positioned on the projectile support platform. This projectile launch key may be dimensioned to removably receive the end of the wing of the projectile and also engage the trailing edge of the wing. Moreover, the projectile launch key may be coupled to the trigger so that the pulling or retraction of the trigger may result in the rotation of the projectile launch key through an arc of between 90 and 80 degrees upon retraction of the trigger.

The projectile launch key may take a variety of forms. For example, the projectile launch key may include a rotatable base having a wall that extends at least partially around the parameter of the base and is dimensioned to engage the end and trailing edge of a wing or blade of a projectile. As shown herein, the projectile launch key may include a rotatable base having a retainer wall dimensioned to engage the end of a wing or blade of a projectile, and a pin dimensioned to engage the trailing edge of a wing or blade. To that end, the trailing edge of the wing of the projectile may include a notched portion that may be engaged by the pin of the projectile launch key and aid in the stable launch of the projectile.

The housing may also include a magazine that is dimensioned to retain a plurality of projectiles and may be configured to cooperate with the trigger to dispense or load projectiles onto the projectile launch key. The magazine, for example, may include a top face, a bottom face that may be spaced from the projectile support platform, and an aperture that extends through the magazine between the top and bottom faces.

To assist in dispensing or loading of projectiles, the magazine may also include a first floor plate and a second floor plate. The plates may be positioned proximate the bottom face of the magazine, with the second floor plate being positioned between the first floor plate and the projectile support platform. The first floor plate may be coupled to the trigger and configured to rotate upon retraction of the trigger to aid in ejecting a projectile from the magazine.

BRIEF DESCRIPTION OF THE DRAWINGS

Reference will be made below to a number of figures in which like referenced numerals refer to like parts throughout and wherein:

FIG. 8 is a planar top or overhead view of the embodiment of the apparatus shown in FIG. 1 showing an embodiment of a projectile positioned in the key of the launch platform;

FIG. 9 is a planar top or overhead view of the embodiment of the apparatus shown in FIG. 1 showing the projectile of FIG. 8 starting to launch;

FIG. 10 is a planar top or overhead view of the embodiment of the apparatus shown in FIG. 1 showing the projectile of FIG. 8 being urged around the launch platform during a launch; and FIG. 11 is a planar top or overhead view of the embodiment of the apparatus shown in FIG. 1 showing the launch of the projectile of FIG. 8.

Figure 1:
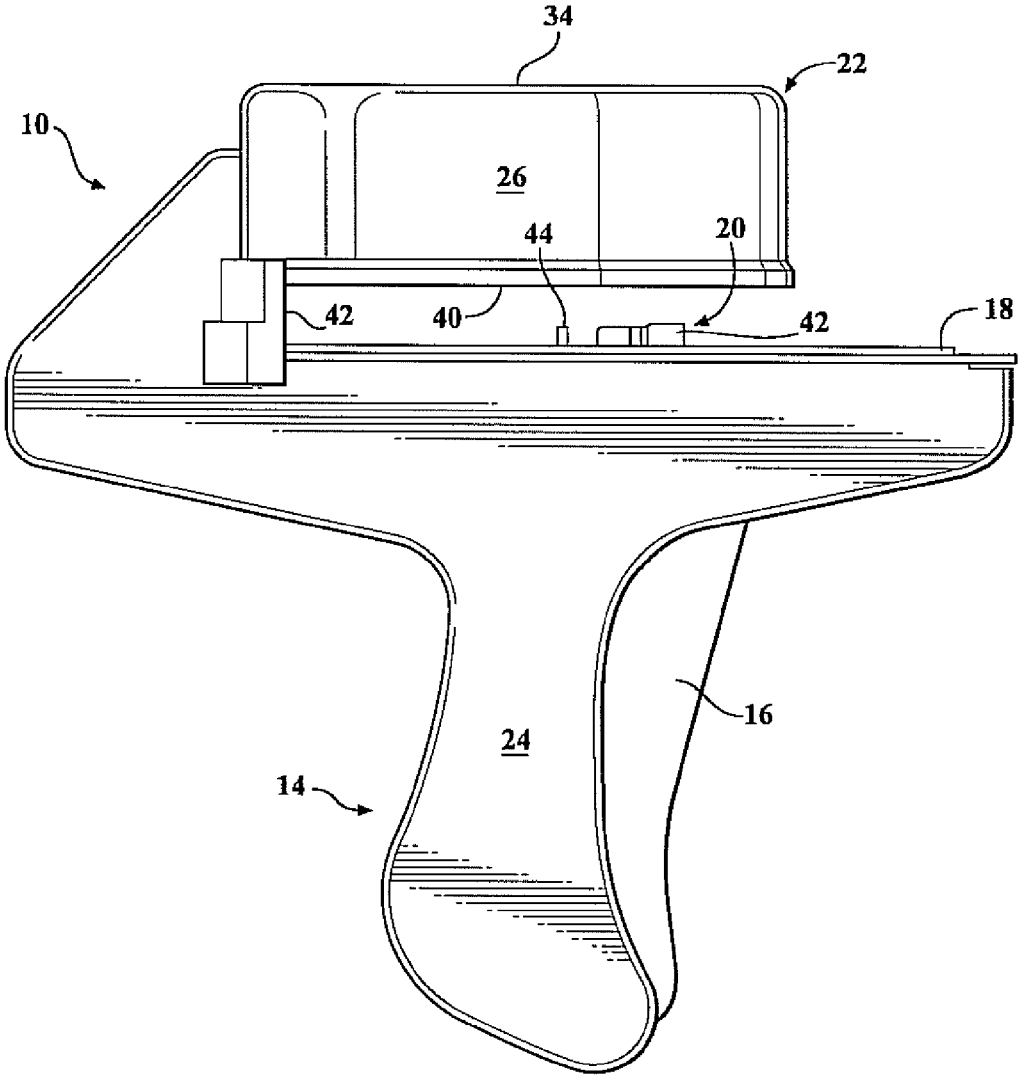
FIG. 1 is a planar left-side view of an embodiment of an apparatus constructed in accordance with the present invention.
Figure 2:
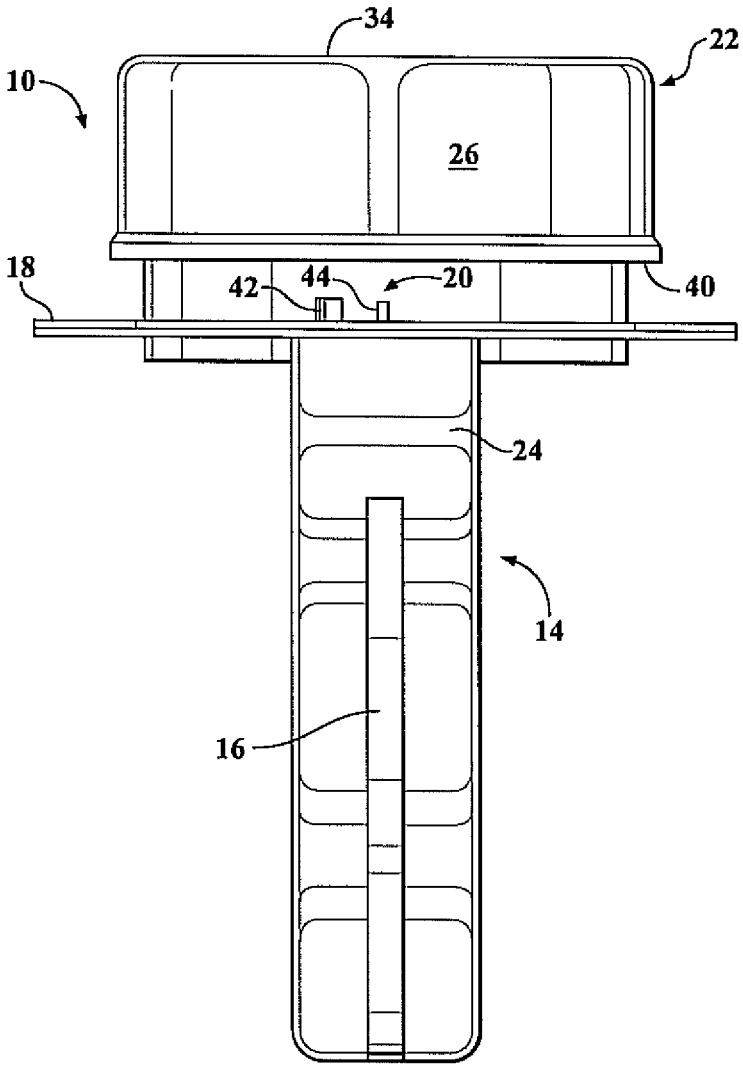
FIG. 2 is a planar front view of the embodiment of the apparatus shown in FIG. 1.
Figure 3:
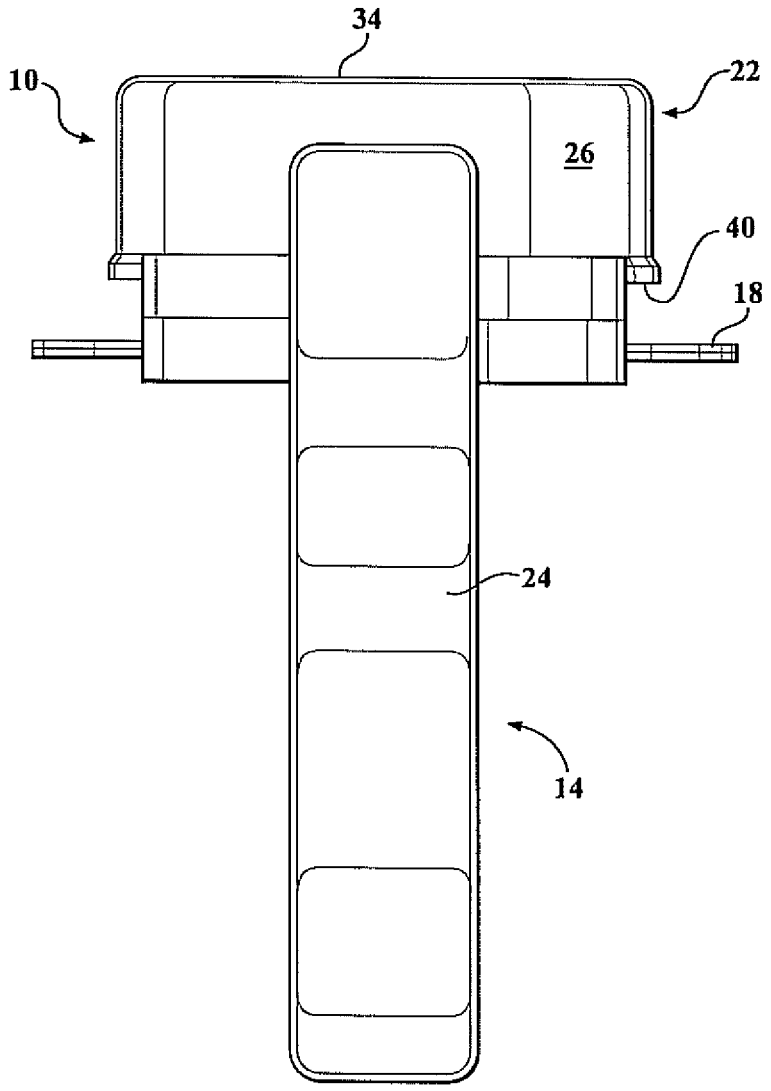
FIG. 3 is a planar rear view of the embodiment of the apparatus shown in FIG. 1.
Figure 4:
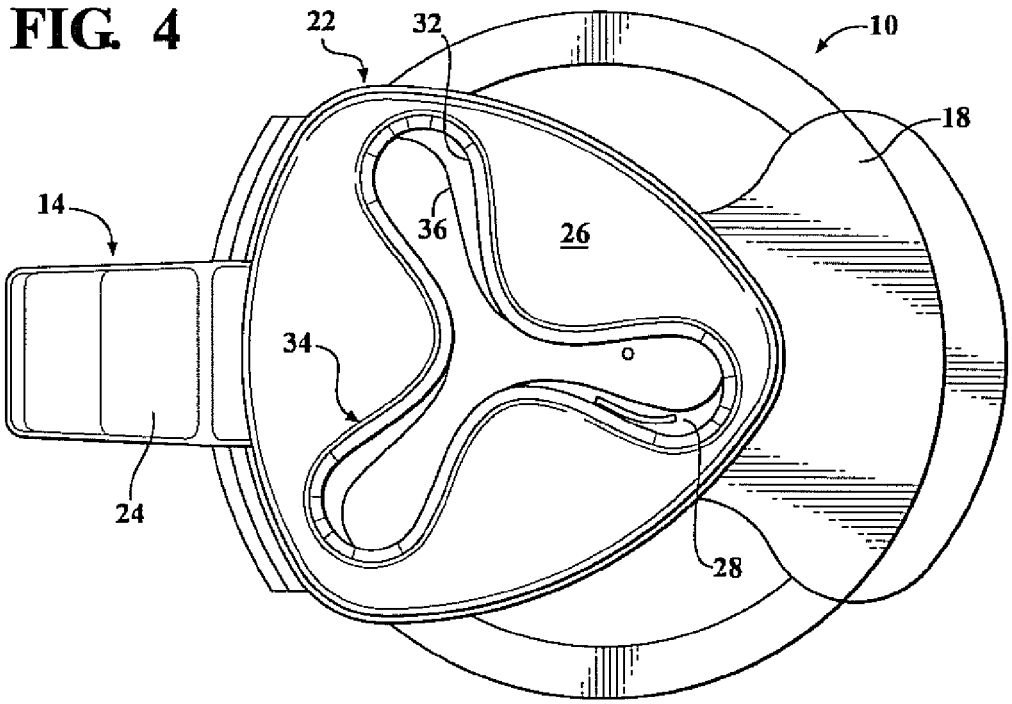
FIG. 4 is a planar top or overhead view of the embodiment of the apparatus shown in FIG. 1 in which the upper plate of the magazine is visible proximate an end of the aperture of the magazine.
Figure 5:
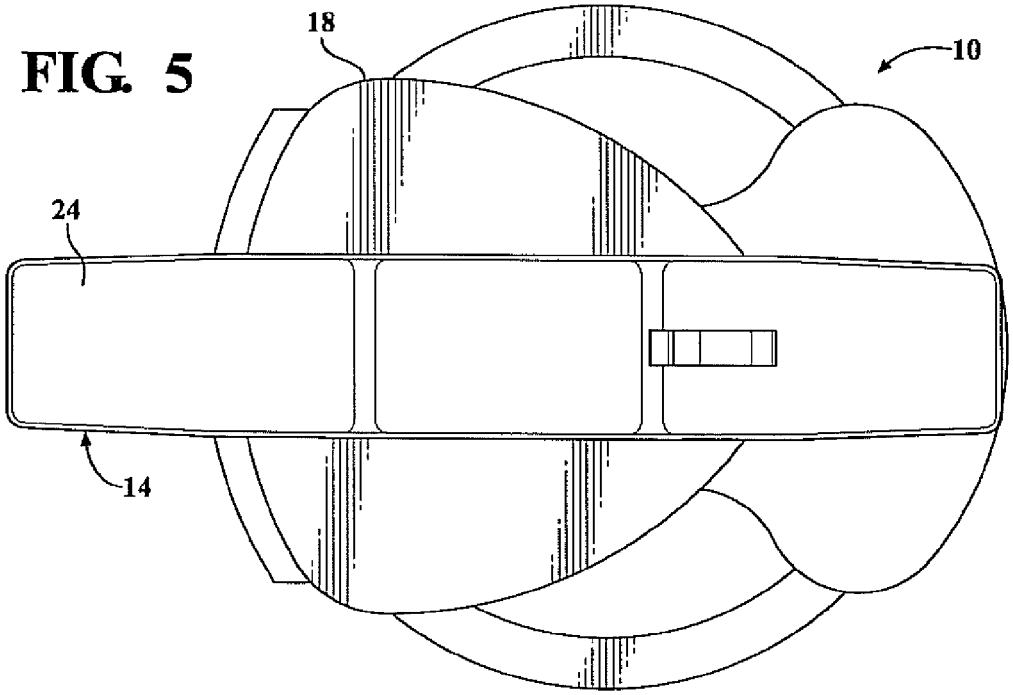
FIG. 5 is a planar bottom or underside view of the embodiment of the apparatus shown in FIG. 1.
Figure 6:
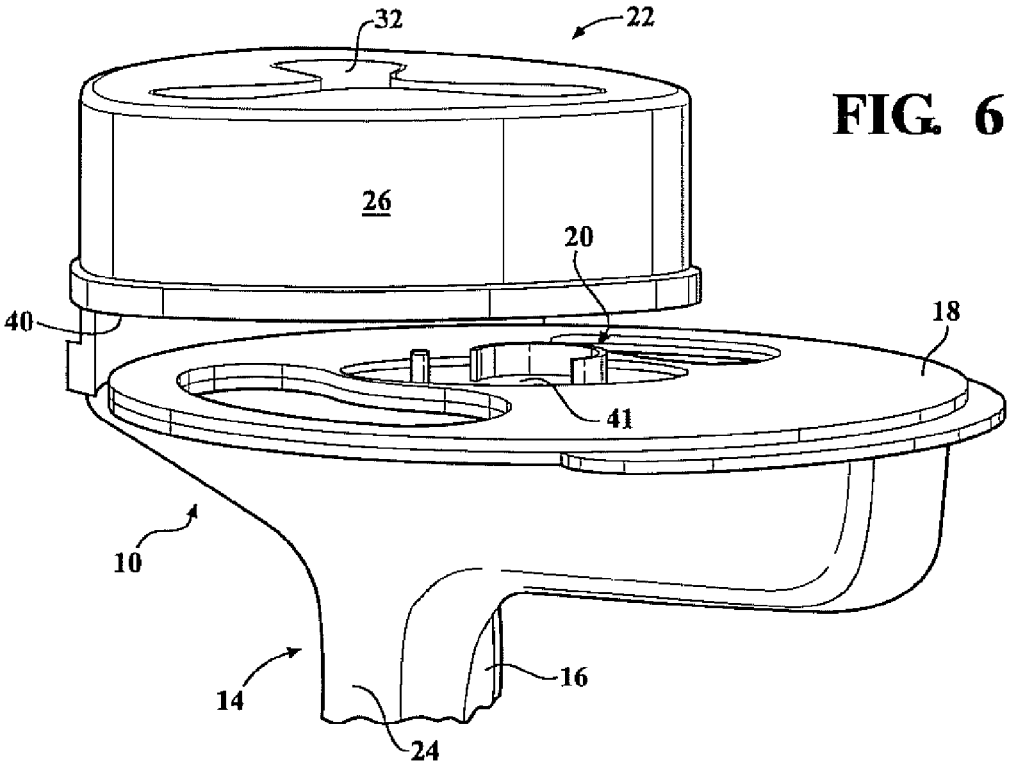
FIG. 6 is perspective view—from the upper left side—of the embodiment of the apparatus shown in FIG. 1, which shows the key of the launch platform.

Additional figures and photographs are attached hereto as Appendix A1-A23 which is incorporated into this application in its entirety by reference.

DETAILED DESCRIPTION OF THE PREFERRED EMBODIMENTS

Referring now to FIGS. 1-11, an apparatus 10 for a launching returnable toy projectile(s) 12 may include a housing having a grip 14 having a trigger 16, a launch or support platform 18 that is mounted to the grip 14 and includes a rotatable launch key 20, and a magazine or projectile storage portion 22 that is secured to the grip 14 and positioned over the launch platform 18 for retaining and selectively ejecting the projectile(s) 12 to be launched. The embodiment(s) for the apparatus 10 disclosed herein may be constructed from molded plastic using known techniques. However, it will be appreciated that other materials such as metal, metal alloys, composite materials, and combinations of the foregoing may also be used in the construction of the apparatus 10 or its constituent parts.

Still referring to FIGS. 1-11, the grip 14 of the apparatus 10 may include a pistol grip style handle 24. The trigger 16 may extend the longitudinal length of the handle 24 and be fitted for reciprocal movement into and out of a recess or space (not shown) defined in the handle 24. The trigger 16 may also be biased by springs (not shown) or the like so that it normally extends outwardly from grip 14. As will be described further infra, pulling the trigger 16 may operate to eject a projectile 12 from the magazine 22 and rotate the launch 20.

Figure 7:
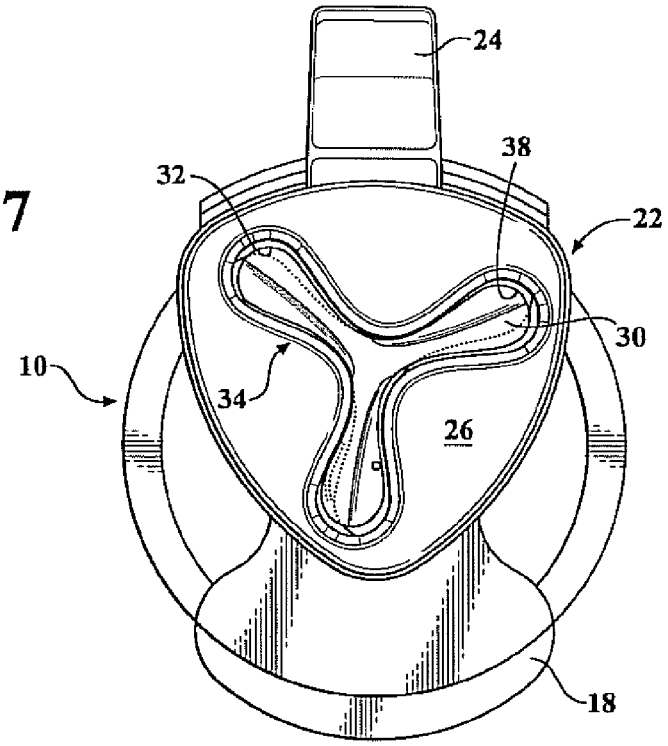
FIG. 7 is a planar top or overhead view of the embodiment of the apparatus shown in FIG. 1 in which the upper plate of the magazine is retracted, but shown in phantom, and the lower plate is visible proximate an end of the aperture of the magazine.

Referring now to FIGS. 1-4, 6-11, the magazine or projectile storage portion 22 of the apparatus 10 may include a body 26 for retaining several projectiles 12, a first or upper floor plate 28 (see FIG. 4), and a second or lower floor plate 30 (see FIG. 7). The body 26, for example, may include an aperture 32 that extends substantially vertically the length of body 26 and is dimensioned to conform to the shape of a projectile 12. Therefore, as shown in the displayed embodiment, the aperture 32 may have a depth sufficient to retain several stacked projectiles 12 and a shape that may include a first, second and third arm that conform to the three symmetrical wings of a three wing or bladed fast catch boomerang style projectile 12. It will however be appreciated that the aperture 20 may be dimensioned to conform to a variety of different returnable projectiles 12, including one or more single wing or bladed projectiles, one or more four wing or bladed projectiles, or any combination of one, three or four bladed projectiles. Additionally, or alternatively, the magazine 22 may be removably secured to the grip 14 so that it may be interchanged with magazines 22 holding a different type of projectile 12.

Referring now to FIGS. 8-11, a projectile may be loaded into the magazine 22 through an open end 34 or top of the aperture 32 of the body 26. It will be appreciated, however, that a removable cap, lid or other structure (not shown) may be provided to cover the open end 34 to limit the ability of projectiles 12 to fall out—as might occur during active play by youths.

Referring now to FIGS. 4 and 8-11, the projectiles 12 may be supported within the aperture 32 of the magazine 22 by the first 28 and a second 30 floor plates. More specifically, each plate 28, 30 may include an aperture 36, 38 dimensioned to conform to the shape of the projectile 12. The plates 28, 30 may also be positioned on or proximate an end 40 of the aperture 32 opposite the open end 34 bottom and function as a (full or partial) support floor for the projectile 12. More specifically, the plates 28, 30 may be positioned relative to each other so that their apertures 36, 38 are in axial alignment, and relative to the aperture 32 of the body 26 so that a portion of each plate (e.g., an edge portion of each aperture 36, 38) extends at least partially across the end 40 of the aperture 32 of the body 26.

Still referring to FIGS. 4 and 8-11, the upper plate 28 may be rotatably mounted to the body 26 and coupled to the trigger 16. For example, the plate 28 and trigger 16 may be mechanically connected by a simple arrangement of gears. It will, however, be appreciated that any mechanical or non-mechanical assembly, including gears, springs, tension means, etc., and other coupling systems known in the art may be used to couple movement of the trigger 16 with a corresponding rotation of the plate 28. Thus, in operation, pulling of the trigger 16 may cause the plate 28 to rotate and retract that portion of the plate 28 that extends across the bottom end 40 of the aperture 32 of the body 26. Stated differently, the plate 28 may rotate so that the aperture 36 of the plate 28 moves into axial alignment with the aperture 32 of the body 26. This movement of the plate 28 allows a projectile 12 in the aperture 32 of the body 26 to descend onto the lower plate 30. The release of the trigger 16 returns the plate 28 to its initial state during which the plate 28 may engage the projectile 12 (which now rests on the lower plate 30) to urge the projectile off and through the aperture of the lower plate 30 so that the projectile 12 may descend into the key 20 of the launch platform 18.

Referring now to FIGS. 1-11, the launch platform may include a planar surface that may be substantially parallel to the lower plate 30 of the magazine 22. As each projectile 12 is ejected from the magazine 22 it may fall a short distance onto the launch platform 18 coming to rest in the launch key 20. The key 20 is coupled to the trigger 16. For example, the key 20 and trigger 16 may be mechanically connected together by a simple arrangement of gears. It will, however, be appreciated that any mechanical or non-mechanical assembly, including gears, springs, tension means, etc., and other coupling systems known in the art may be used to couple movement of the trigger 16 with a corresponding rotation of the key 20.

As shown, the key 20 may be positioned at a central point of the launch platform 18. It will however be appreciated that the key should be located a distance from a backside 42 of the platform 18 sufficient to allow a projectile 12 to rotate completely around the platform 18 during launch as will be described further below. The launch key 20 may include a base 41, and a retainer wall 42 and a pin 44 that extend from the base 41. The wall 42 may be dimensioned to engage and removably retain an end or apex of an wing of a projectile 12. The vertically extending pin may be positioned on the key 20 so that it may engage a trailing edge of the wing of the projectile 12 that is engaged by the retainer wall 42. A notch 46 may be included in the trailing edge of the wing of the projectile that may be engaged by the pin 44 to assist in the engagement of the projectile 12 by the key 20.

In operation, a user loads a projectile into the aperture 32 so that it rests upon the upper plate 28, which functions as the floor of the magazine 22. A user may then pull the trigger, causing the plate 32 to retract out of position and allow the projectile 12 to descend so that it rests on the lower plate 30 of the magazine 22. Then, upon release of the trigger 16, the upper plate 28 (in returning to its unretracted original state) urges the projectile 12 off the lower plate 30 and into the key 20 of the launch platform 18. Pulling the trigger 16 again may result in the rapid rotation of the launch key 20 through an arc of about 450 degrees (although any greater (e.g., 810 degrees) or lesser (e.g., 90 degrees) predetermined angle of rotation may be used depending on the needs of the user). The projectile 12 is likewise urged through this rotation by operation/rotation of the key 20. For example, in the disclosed embodiment, the retainer wall 42 and pin 44 may engage the projectile, allowing it to be propelled and then launched by rotation of the key 20. More specifically, the rotation of the key 20 has the effect of inducing speed, forward momentum and rotation on the projectile 12 causing it to travel outward from the housing/launcher. The shape of the projectile 12, and/or the orientation at which the apparatus 10 is held during launch (e.g., an angle of attack between 0 and positive 60 degrees relative to the horizon) may also aid in the return of the projectile to at or near the point of launch.

Having thus described an embodiment of the apparatus, various other embodiments will become apparent to those of skill in the art that do not depart from the skill of the claims.

I claim:

1. A toy apparatus comprising:

a projectile including at least two wing portions, each wing portion having an end, a leading edge and a trailing edge; and a housing including a grip, a trigger, a magazine operable to contain a plurality of projectiles, and a projectile support platform, the magazine including a top face, a bottom face, a first floor plate and a second floor plate, and the magazine defining an aperture that extends through the magazine between the top and bottom faces, and the bottom face being spaced apart from the projectile support platform, and the plates being positioned proximate the bottom face of the magazine, with the second floor plate being positioned between the first floor plate and the projectile support platform, and the first floor plate being coupled to the trigger and operating to rotate upon retraction of the trigger, and the projectile support platform including a projectile launch key, the projectile launch key being dimensioned to engage the trailing edge of at least one wing portion, and the projectile launch key being coupled to the trigger and operating to rotate upon retraction of the trigger.

2. The toy apparatus of claim 1, wherein the projectile launch key comprises a retainer wall and a pin, the retainer wall being dimensioned to engage the end of at least one wing portion.

3. The toy apparatus of claim 2, wherein the trailing edge of at least one wing portion of the projectile comprises a notched portion, the notched portion being engagable by the pin of the projectile launch key.

4. The toy apparatus of claim 1, wherein the projectile support platform further comprises a planar surface that is spaced from and substantially parallel to the second floor plate of the magazine.

5. The toy apparatus of claim 1, wherein the first floor plate and a second floor plate each plate includes an aperture that extends through the plate and is shaped to accept the shape of the projectile.

6. The toy apparatus of claim 1, wherein the projectile comprises at least three wing portions.

7. The toy apparatus of claim 1, wherein the projectile launch key is configured to rotate through an arc of between 90 and 810 degrees upon retraction of the trigger.

8. The toy apparatus of claim 1, wherein the trailing edge of the wing portion of the projectile comprises a notched portion.

9. The toy apparatus of claim 1, wherein the trigger is positioned in the grip of the housing.

10. The toy apparatus of claim 1, wherein the trigger is mechanically connected to the projectile launch key.

11. A toy apparatus comprising:

a projectile including at least two wing portions, each wing portion having an end, a leading edge and a trailing edge; and a housing including a grip, a trigger, a magazine operable to contain a plurality of projectiles, and a projectile support platform, the magazine including a face defining an aperture, a first floor plate and a second floor plate, the plates being positioned proximate the face of the magazine, with the second floor plate being positioned between the first floor plate and the projectile support platform, and the first floor plate being coupled to the trigger and operating to rotate upon retraction of the trigger, and the projectile support platform including a projectile launch key and having a planar surface that is spaced from and substantially parallel to the face of the magazine, the projectile launch key being dimensioned to removably receive the end of the wing portion of a projectile dispensed through the aperture of the face of the magazine, and the projectile launch key being coupled to the trigger and operating to rotate upon retraction of the trigger.

12. The toy apparatus of 11, wherein the trigger is mechanically connected to the projectile launch key.

13. The toy apparatus of claim 11, wherein the projectile launch key comprises a retainer wall and a pin, the retainer wall being dimensioned to engage the end of at least one wing portion.

14. The toy apparatus of claim 13, wherein the trailing edge of at least one wing portion of the projectile comprises a notched portion, the notched portion being engagable by the pin of the projectile launch key.

15. The toy apparatus of claim 11, wherein the projectile comprises at least three wing portions.

16. The toy apparatus of claim 11, wherein the projectile launch key is configured to rotate through an arc of between 90 and 810 degrees upon retraction of the trigger.

17. The toy apparatus of claim 11, wherein the trigger is positioned in the grip of the housing.

* * * * *